US008555448B2

(12) United States Patent
Fellinger

(10) Patent No.: US 8,555,448 B2
(45) Date of Patent: Oct. 15, 2013

(54) ROLLER FOR A ROTARY SCRUBBER

(75) Inventor: Thomas J. Fellinger, Littleton, CO (US)

(73) Assignee: Johns Manville, Denver, CO (US)

( * ) Notice: Subject to any disclaimer, the term of this patent is extended or adjusted under 35 U.S.C. 154(b) by 1075 days.

(21) Appl. No.: 11/528,272

(22) Filed: Sep. 27, 2006

(65) Prior Publication Data

US 2008/0081752 A1 Apr. 3, 2008

(51) Int. Cl.
*B23D 67/06* (2006.01)
*A47L 13/08* (2006.01)

(52) U.S. Cl.
USPC ..... 15/93.1; 15/230.16; 15/236.1

(58) Field of Classification Search
USPC ..... 15/93.1, 93.4, 97.1, 98, 230, 230.11, 15/230.16, 363, 366, 383, 236.1, 141.1, 15/256.51, 256.62; 492/30, 36
See application file for complete search history.

(56) References Cited

U.S. PATENT DOCUMENTS

| | | | | | |
|---|---|---|---|---|---|
| 2,169,206 | A | * | 8/1939 | Krongold | 15/245 |
| 2,689,369 | A | * | 9/1954 | Bick | 15/245 |
| 3,448,479 | A | * | 6/1969 | Cademartori | 15/230.11 |
| 4,191,792 | A | | 3/1980 | Janssen | |
| 4,404,703 | A | | 9/1983 | Woodall, Jr. et al. | |
| 4,566,911 | A | * | 1/1986 | Tomita et al. | 134/6 |
| 4,677,815 | A | | 7/1987 | Stahlecker | |
| 4,734,729 | A | | 3/1988 | Hertzel et al. | |
| 5,090,084 | A | * | 2/1992 | De Guzman | 15/230.11 |
| 5,167,719 | A | | 12/1992 | Tamaki | |
| 5,255,407 | A | * | 10/1993 | Yang | 15/250.22 |
| 5,365,628 | A | * | 11/1994 | Evensen | 15/23 |
| 5,401,231 | A | | 3/1995 | Hebert | |
| 5,639,311 | A | * | 6/1997 | Holley et al. | 134/6 |
| 5,713,095 | A | | 2/1998 | Wakat | |
| 6,091,918 | A | * | 7/2000 | Kellie et al. | 399/249 |
| 6,280,371 | B1 | | 8/2001 | Krippelz | |
| RE37,657 | E | * | 4/2002 | Lucas | 242/542.4 |
| 6,875,162 | B2 | | 4/2005 | Barksdale et al. | |

OTHER PUBLICATIONS

IDI Distributors Inc, "Stud Scrubber," Online Brochure, http://idimn.com/pages.spray_insulation.html, Mar. 2006.

(Continued)

*Primary Examiner* — Dung Van Nguyen
(74) *Attorney, Agent, or Firm* — Robert D. Touslee

(57) ABSTRACT

This relates generally to devices used in the removal of excess spray-applied insulation from building components, and more particularly to an improved roller for rotary scrubbers used in the removal of such excess insulation. A rotary scrubber generally comprises a hand-held device having a roller assembly rotatably associated with a forward end of an arm or a pair of arms of the device. The roller assembly, comprised of one or more rollers and adapted for driven, rotatable association with the scrubber, is driven to rotate by a motor and one or more associated drive belts located on the device. The improved roller comprises a cylindrical body having an at least an outer surface defining a plurality of longitudinal ribs, with each rib defining at least one longitudinal edge to enhance the removal of excess spray-applied insulation. The ribs may be machined or cut into the outer surface of each roller, or the ribs may be formed by a molding or extrusion process. The cylindrical body, to include the ribs, is preferably comprised of a polyurethane material having a hardness that resists wear incurred by the roller when contacting framing members during scrubbing operations. Each rib may have a triangular cross-section, a cross-section defining at least two right angles, or a cross-section defining a blade, to define the at least one longitudinal edge.

4 Claims, 10 Drawing Sheets

(56) References Cited

OTHER PUBLICATIONS

ADO Products, "Stud Scrubbers," Online Brochure, Http://www.adodistribution.com, Mar. 2006.

Krendel Fiber Moving Equipment, "Wall Scrubber," Online Brochure, http://krendlmachine.com/products.wallcavitysystems.asp, Mar. 2006.

* cited by examiner

ROLLER FOR A ROTARY SCRUBBER

TECHNICAL FIELD

This relates generally to devices used in the removal of excess spray-applied insulation from building components, and more particularly to an improved roller for rotary scrubbers used in the removal of such excess insulation.

BACKGROUND

Sprayed insulation is commonly used in the construction industry for insulating the open cavities of building walls, floors, ceilings, attics and other areas. Insulation materials, such as loose fiberglass, rock wool, mineral wool, fibrous plastic, cellulose, ceramic fiber, etc., that is combined with an adhesive or water, are sprayed from an applicator into such open cavities to reduce the rate of heat loss or gain therethough. The adhesive properties of the insulation mixture, resulting from the combination of the insulation materials with the adhesive or water, allow it to adhere to vertical or overhanging surfaces, thus allowing for an application of insulation prior to the installation of wallboard and similar cavity enclosing materials.

In applying sprayed insulation into open cavities, an installer typically holds an outlet end of the applicator towards the open cavity and then sprays the insulation and adhesive mixture into the cavity until the cavity is filled. To ensure that the cavity is completely filled, an installer typically sprays an excess amount of the mixture into the cavity such that an excess quantity (i.e. overfill) of the sprayed insulation has accumulated beyond an opening of the cavity defined by the cavity's confining boundaries, i.e. beyond the wall studs, floor or ceiling joists or other framing members defining the cavity. Such an excess amount or overfill is often necessary to ensure a complete fill of the cavity with the insulation mixture, thus minimizing the presence of gaps or voids therein and ensuring that the claimed thermal or acoustic performance, as specified by the manufacturer of the insulation product, is met.

However, to allow for the installation of wallboard, a vapor retarder or other surface materials over the cavity after receiving the insulation mixture, the excess or overfill insulation must be compacted into the cavity or removed therefrom to allow the surface materials to lay flush against the framing members. Excess insulation mixture located on the faces or outer surfaces of the framing members must be removed as well. The excess or overfill sprayed insulation mixture is thus removed or "scrubbed" from the cavity and faces of the framing members with a rotary scrubber to define an outer surface or boundary of the mixture at the cavity's opening lying preferably co-planar with the faces of the framing members.

The rotary scrubber generally comprises a hand-held device having a rotating, motor-driven roller assembly attached thereto. The roller assembly, typically located at a forward end of a framework of the device and comprising at least one cylindrical brush or textured roller, is driven to rotate by a motor and associated drive belt, also located on the device. The drive belt is in contact with the roller assembly via a pulley or channel defined in the outer surface of the brush or wheel. The rotating roller assembly preferably has an end-to-end length that spans or exceeds the width of a building cavity as defined by the framing members.

Thus, during the removal process, the rotating roller assembly is positioned against the faces of the framing members to span the width of the cavity. The rotating roller assembly is then pulled along the framing members, preferably in a direction about parallel thereto, such that an outer, textured surface of the cylindrical brush or roller contacts and scrubs the excess or overfill insulation mixture from the cavity and framing members, thus creating the outer surface or boundary of the insulation that is preferably co-planar with the framing members.

Although various textured rollers are presently-available for use with the roller assemblies of rotary scrubbers, such rollers suffer from various disadvantages. For example, presently-available rollers have a textured outer surface that is prone to clogging. Thus, as the textured outer surface of the wheel contacts the overfill insulation during the scrubbing process, the insulation becomes caught within the textured, outer surface, thus clogging the outer surface of the roller and negating the ability of the texture to further remove insulation. Also, such presently-available rollers typically utilize a textured, outer surface comprised of fibrous material having an absence of longitudinal edges that enhance the removal of spray-applied insulation material.

Furthermore, presently-available rollers are comprised of non-durable materials that are prone to premature wear, thus limiting assembly's life-span. As such rollers contact framing members during the scrubbing process, the frictional contact between a given assembly and the framing members result in a degradation of the textured, outer surface of the roller, limiting the assembly's life-span and again negating the ability of the texture to further remove insulation.

Thus, what is needed is a rotary scrubber roller having a textured, outer surface that is not prone to clogging. The textured, outer surface should include longitudinal edges that enhance the removal of spray-applied insulation. The textured, outer surface should also be comprised of durable materials not prone to frictional wear, thus extending the life-span and usefulness of the roller. This fulfills these foregoing needs.

SUMMARY

This relates generally to devices used in the removal of excess spray-applied insulation from building components, and more particularly to an improved roller for rotary scrubbers used in the removal of such excess insulation. A rotary scrubber generally comprises a hand-held device having a roller assembly rotatably associated with a forward end of an arm or a pair of arms of the device. The roller assembly, comprised of one or more rollers and adapted for driven, rotatable association with the scrubber, is driven to rotate by a motor and one or more associated drive belts located on the device. The rotating roller assembly preferably has an end-to-end length that spans or exceeds the width of a building cavity as defined by the framing members.

At least one improved roller may be utilized as the roller assembly for various types of scrubbers. For example, the at least one roller may be utilized with the roller assembly of a scrubber having a single arm whereby each of the first and second rollers of the assembly respectively located adjacent to the arm of the device is each comprised of the at least one roller. The at least one roller may also be utilized with the roller assembly of a scrubber having a pair of arms whereby a central roller located between each arm of the device, as well as each outer roller of the assembly located outwardly of each respective arm, is each comprised of the at least one roller. Furthermore, the roller assembly may be comprised of a single roller comprised of the at least one roller.

Each roller preferably comprises a cylindrical body having an at least an outer surface defining a plurality of longitudinal ribs, with each rib defining at least one longitudinal edge to enhance the removal of excess spray-applied insulation. The outer surface of the cylindrical body of each roller defines between about 15 ribs and about 35 ribs, preferably about 22 ribs. The ribs may be machined or cut into the outer surface of each roller, or the ribs may be formed by a molding or extrusion process. The cylindrical body, to include the ribs, is preferably comprised of a polyurethane material having a durometer hardness of from about 60A to about 85D, preferably about 75D, to resist wear incurred by the roller when contacting framing members during scrubbing operations. Each rib may have a triangular cross-section, a cross-section defining at least two right angles, or a cross-section defining a blade, to define the at least one longitudinal edge.

The rotatable association of each roller to a given scrubber is facilitated by various means understood in the art. A roller assembly shaft extends through an assembly bore defined at the forward end of each arm scrubber and at least into each roller of the assembly. In one embodiment, each roller of the assembly rotates about the shaft connected to the arm or arms of the scrubber via thrust bearing and race assemblies located between the shaft and each roller. In another embodiment, each roller of the assembly is affixed to the shaft, with the shaft rotatably connected to the arm or arms of the scrubber via one or more press-fit bearing and race assemblies located there-between.

To accommodate the operable relation between the roller assembly and the scrubber's drive belt or belts, in one embodiment, the outer surface of the body of each roller end, located adjacent to an arm or arms of the scrubber, defines at least one circumferal inlet that together define a groove or grooves in the roller assembly for operable engagement with the drive belt or belts. Alternatively, roller supports located at roller ends located adjacent to the arm or arms of the scrubber each define a pulley surface that together define a pulley or pulleys in the roller assembly for operable engagement with the drive belt or belts.

DESCRIPTION OF THE EMBODIMENTS

Figure 1:
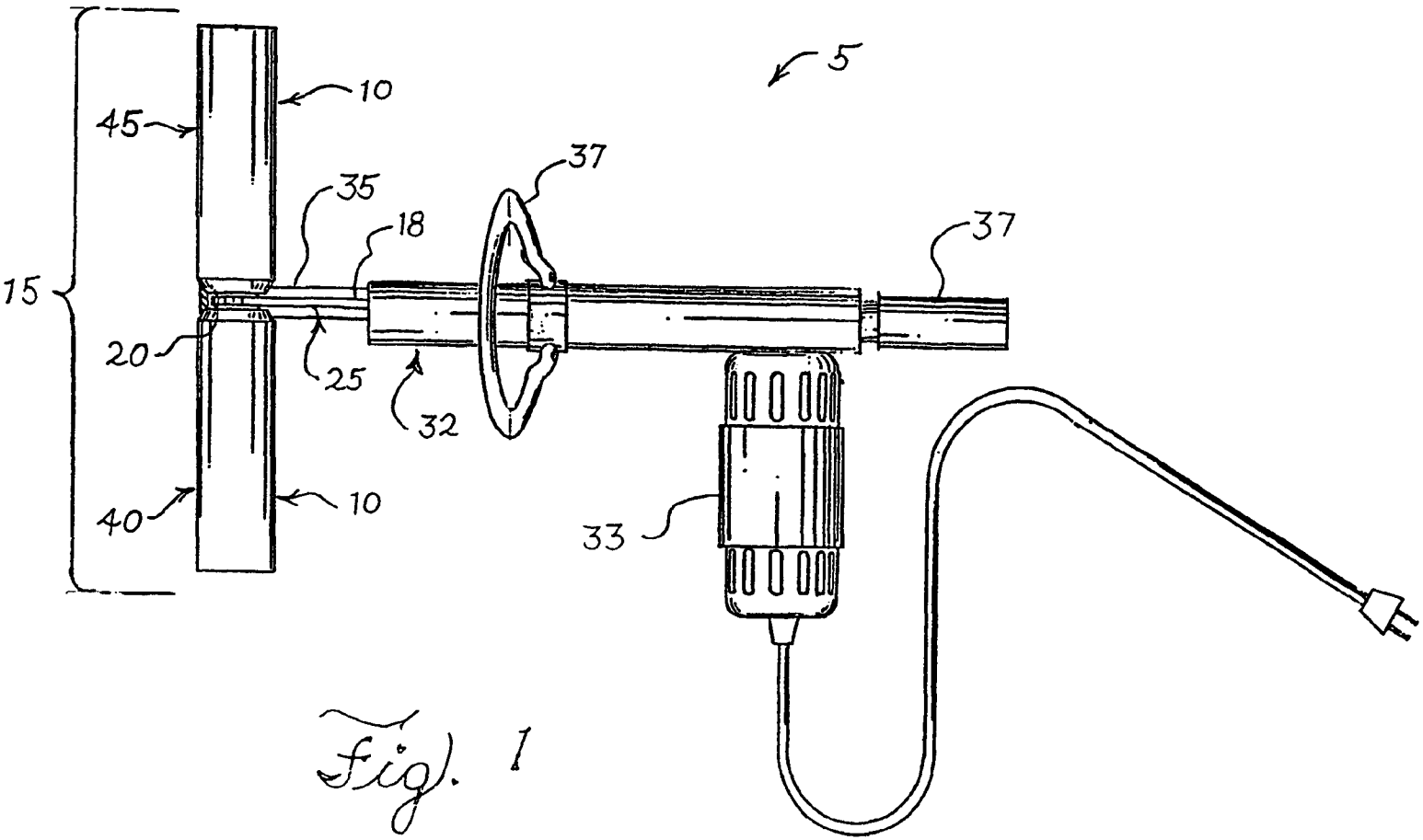
FIG. 1 is a plan view illustrating the roller as part of a roller assembly utilized with a scrubber having one arm.
Figure 2:
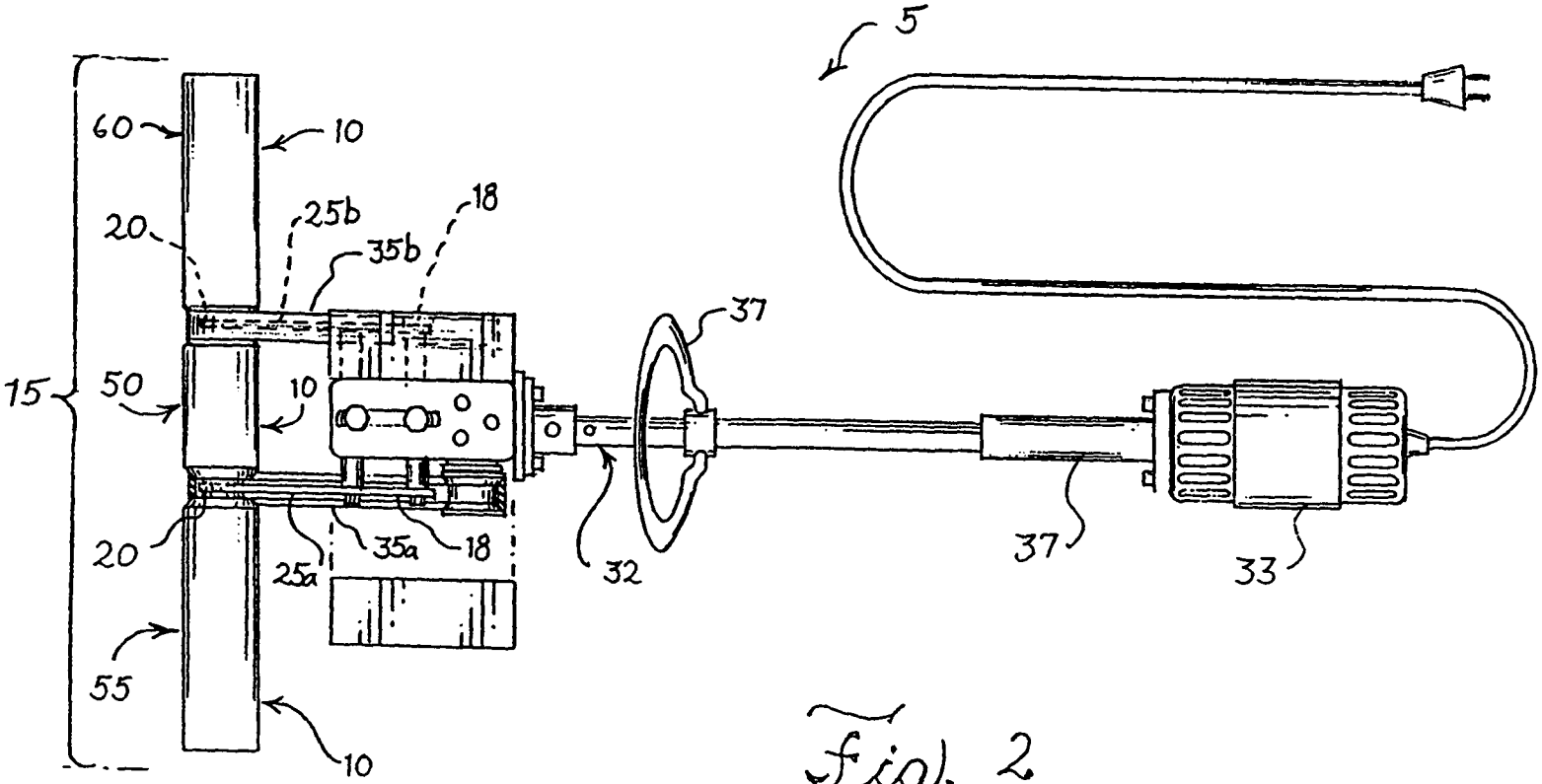
FIG. 2 is a plan view illustrating the roller as part of a roller assembly utilized with a scrubber having a pair of arms.

This relates generally to devices used in the removal of excess spray-applied insulation from building components, and more particularly to an improved roller for rotary scrubbers used in the removal of such excess insulation. FIGS. 1 and 2 each illustrate the basic components of a typical rotary scrubber 5 utilizing one embodiment of the improved roller 10 as part of a roller assembly 15. As illustrated therein, the rotary scrubber 5 generally comprises a hand-held device having the roller assembly 15 rotatably associated with a forward end 20 of at least one arm, i.e., an arm 25 (FIG. 1) or a pair of arms 25*a* and 25*b* (FIG. 2) of the device. Also referring to FIGS. 6, 7 and 12, the arm 25 and pair of arms 25*a* and 25*b*, in addition to defining a forward end 20, also define a rearward end 18 and upper and lower edges 26 and 27, with the arm defining sides 28 and 29 and the pair of arms defining inner and outer sides 30 and 31 (only one arm 25 shown by example in FIG. 12). The rearward end 18 of each arm or arms is preferably connected to a housing 32 or other structure of the device. The roller assembly 15, comprised of at least one improved roller 10 and adapted for driven, rotatable association with the forward end of the at least one arm of the scrubber 5, is driven to rotate by a motor 33 and one or more associated drive belts (belt 35 of FIG. 1 and belts 35*a* and 35*b* of FIG. 2), also located on the device, with the drive belt or belts in one embodiment entrained around the arm or arms, respectively. The rotating roller assembly 15 preferably has an end-to-end length that spans or exceeds the width of a building cavity as defined by the framing members. One or more handles 37 are also preferably connected to each respective scrubber to facilitate a secure grip thereof by respective users.

As illustrated in the forgoing figures, the roller assembly 15 may be comprised of the at least one improved roller 10 in a variety of configurations for various embodiments of scrubbers. For example, as illustrated in FIG. 1, the at least one roller 10 is utilized with the roller assembly 15 of a scrubber 5 having a single arm 25 whereby the first and second roller 40 and 45 of the assembly respectively located adjacent to the arm 25 of the device are each comprised of the at least one roller of the assembly. As illustrated in FIG. 2, the at least one roller 10 is also utilized with the roller assembly 15 of a scrubber 5 having a pair of arms 25*a* and 25*b* whereby the central roller 50, located between each arm 25*a* and 25*b* of the device, as well as each outer roller 55 and 60 of the assembly located outwardly of each respective arm, are each comprised of the at least one roller of the assembly.

Although FIG. 1 illustrates the roller assembly 15 as comprising two rollers (i.e. first and second rollers 40 and 45) of the at least one roller 10 associated with the arm 25, it is understood that the roller assembly may comprise a single roller of the at least one roller located to one side of the arm. Also, although FIG. 2 illustrates the roller assembly 15 as having three rollers (i.e., the central roller 50 and outer rollers 55 and 60) of the at least one roller 10 associated with the arms 25*a* and 25*b*, it is understood that the roller assembly may comprise a single roller (i.e. a central roller alone) of the at least one roller located between the arms.

Figure 3:
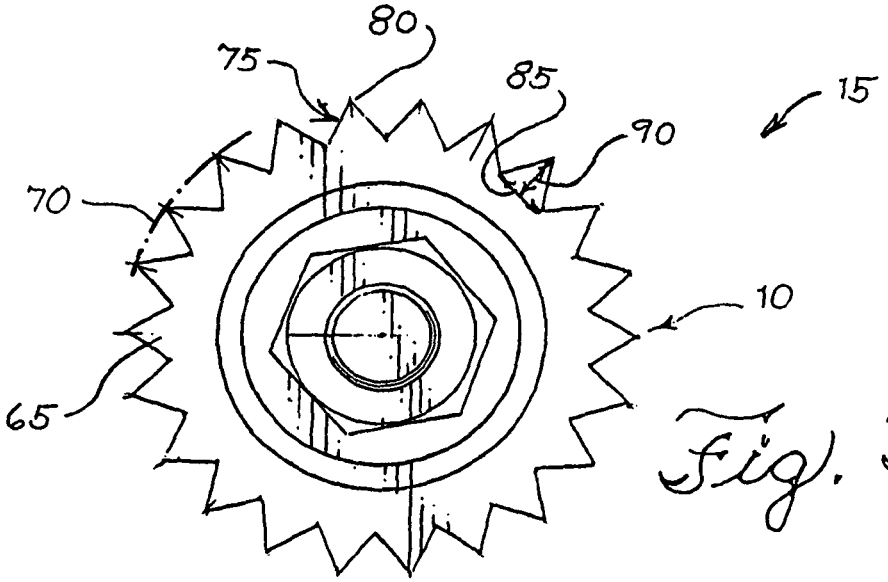
FIG. 3 is an end view of the roller having an outer surface defining ribs having a triangular cross-section.
Figure 4:
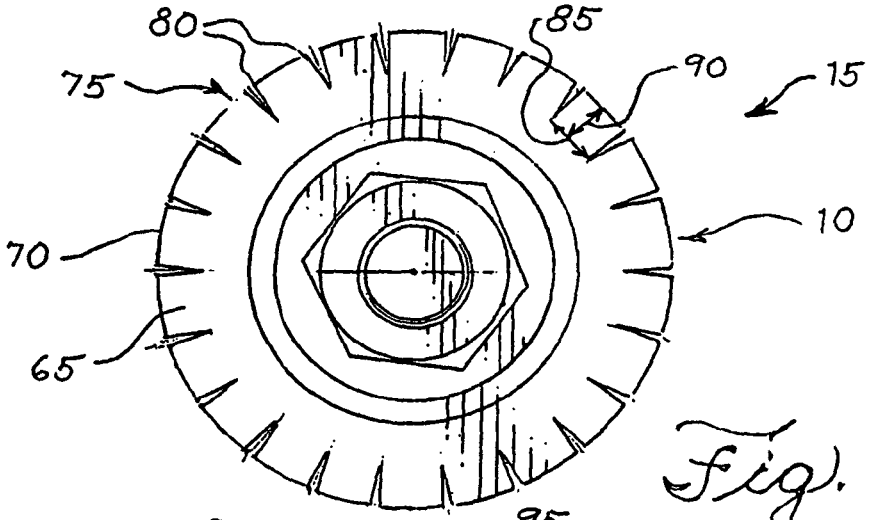
FIG. 4 is an end view of the roller having an outer surface defining ribs having a cross-section defining at least two right angles.
Figure 5:
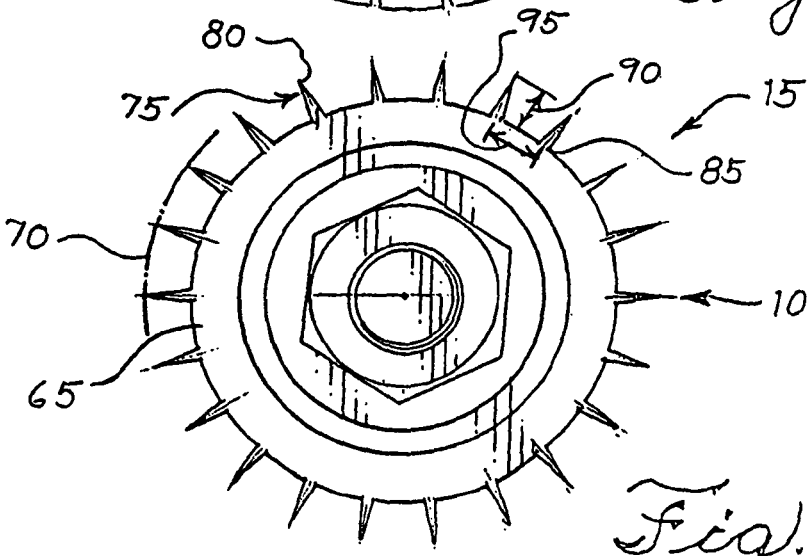
FIG. 5 is an end view of the roller having an outer surface wherein each rib has a cross-section defining a blade.

FIGS. 3, 4 and 5 each illustrate end views of the at least one roller 10 as part of the roller assembly 15. As illustrated therein, each roller 10 comprises a cylindrical body 65 having at least an outer surface 70 defining a plurality of longitudinal ribs 75, with each rib defining at least one longitudinal edge 80 along the body to enhance the removal of excess spray-applied insulation. In the embodiments illustrated in FIGS. 3, 4 and 5, the ribbed outer surface 70 of the cylindrical body 65 of each roller defines a roller outside diameter of between about 1 inch and about 5 inches, preferably between about 2 inches and about 3 inches, and more preferably about 2 inches. Also in these embodiments, the outer surface 70 of the cylindrical body 65 of each roller 10 defines between about 15 ribs and about 35 ribs, preferably about 22 ribs.

The ribs 75 may be machined or cut into the outer surface 70 of each roller 10, or the ribs may be formed by a molding or extrusion process. The cylindrical body 65 of each roller 10 preferably has a length of between about 1 inch and about 62 inches. In one embodiment, the cylindrical body 65, to include the ribs 75, is preferably comprised of a polyurethane material having a durometer hardness of from about 60A to about 85D, preferably about 75D, to resist wear incurred by the roller 10 when contacting framing members during scrubbing operations. However, it is understood that other wear-resistant materials may be utilized, to include rubbers, plastics, metals, alloys and other similar materials.

FIG. 3 illustrates an embodiment of the improved roller 10 wherein each rib 75 has a triangular cross-section. As illustrated therein, the triangular cross-section of each rib preferably defines a base 85 having a width of between about ⅛ of an inch and about ½ of an inch, more preferably about 3/16 of an inch, and a height 90 defining a radial distance from the base of between about ⅛ of an inch and about ¼ of an inch, more preferably about 3/16 of an inch. In one embodiment, the base 85 of each rib 75 is longitudinally co-terminus with one another such that no space exists circumferentially there-between. However, it is understood that in other embodiments, the base 85 of each rib 75 is not longitudinally co-terminus with one another such that a longitudinal space is of a predetermined width is defined there-between. In the embodiment of FIG. 3, the apex of the triangular cross-section of each rib 75 thus defines a longitudinal edge 80 of the at least one longitudinal edge that enhances the removal of the spray-applied insulation during the scrubbing process.

FIG. 4 illustrates an embodiment of the improved roller 10 wherein each rib 75 has a cross-section defining at least two right angles. As illustrated therein, the cross-section of each rib 75 preferably defines a base 85 having a width of between about ⅛ of an inch and about ½ of an inch, more preferably about 3/16 of an inch, and a height 90 defining a radial distance from the base of between about ⅛ of an inch and about ¼ of an inch, more preferably about 3/16 of an inch. In one embodiment, the base 85 of each rib 75 is again longitudinally co-terminus with one another such that no space exists circumferentially there-between. However, it is again understood that in other embodiments, the base 85 of each rib 75 is not longitudinally co-terminus with one another such that a longitudinal space of predetermined width is defined there-between. In the embodiment of FIG. 4, the right angles defined by the cross-section of each rib define a pair of longitudinal edges 80 of the at least one longitudinal edge that enhances the removal of spray-applied insulation during the scrubbing process.

FIG. 5 illustrates an embodiment of the improved roller 10 wherein each rib 75 has a cross-section defining a blade. As illustrated therein, the cross-section of each rib preferably defines a base 85. A spacing 95 of between about ⅛ of an inch and about ½ of an inch, more preferably about 3/16 of an inch, is defined between each rib 75 (i.e., blade). The cross-section of each rib also preferably defines a height 90 defining a radial distance from the base of between about ⅛ of an inch and about ¼ of an inch, more preferably about 3/16 of an inch. In the embodiment of FIG. 5, the tip of the blade cross-section of each rib 75 thus defines a longitudinal edge 80 of the at least one longitudinal edge that enhances the removal of the spray-applied insulation during the scrubbing process.

Figure 6:
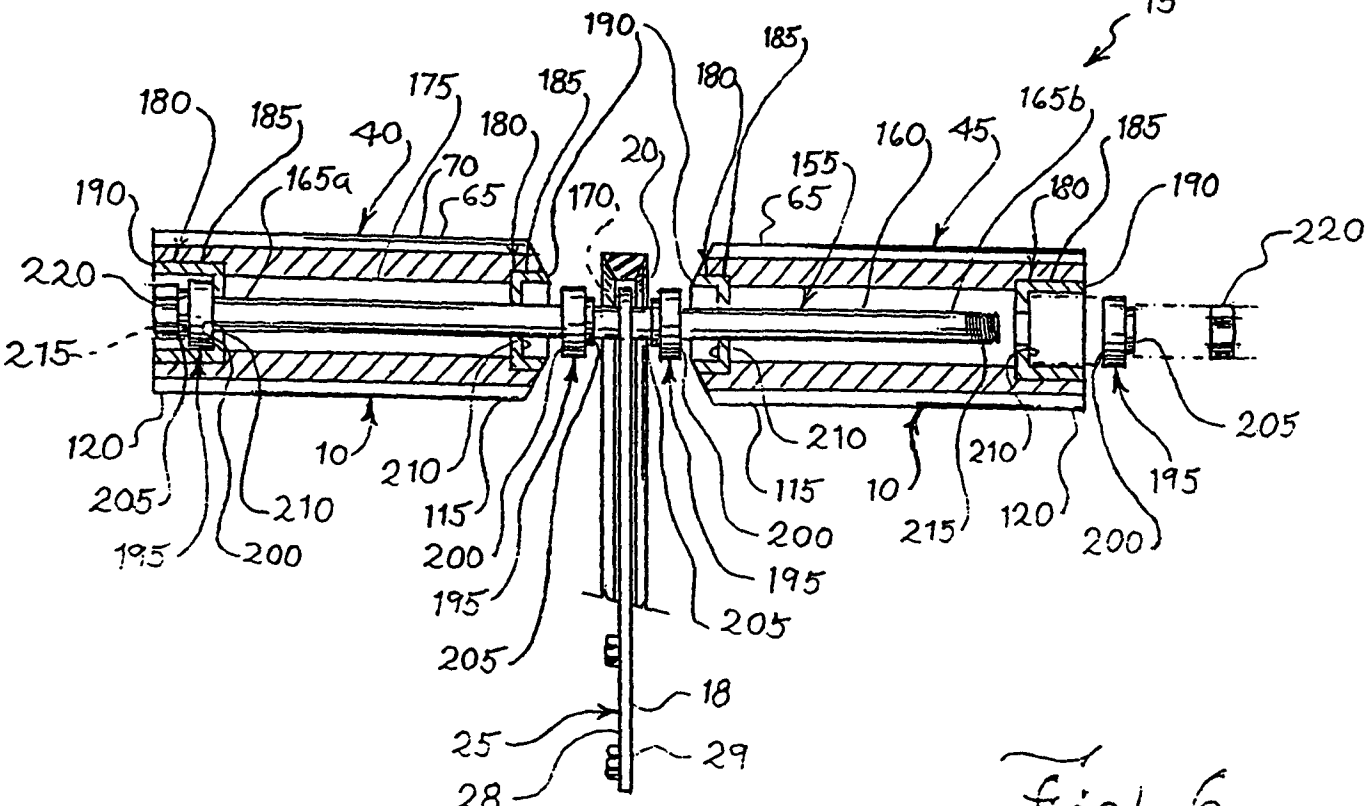
FIG. 6 is a sectional assembly view of the rollers of the roller assembly of the scrubber illustrated in FIG. 1.
Figure 7:
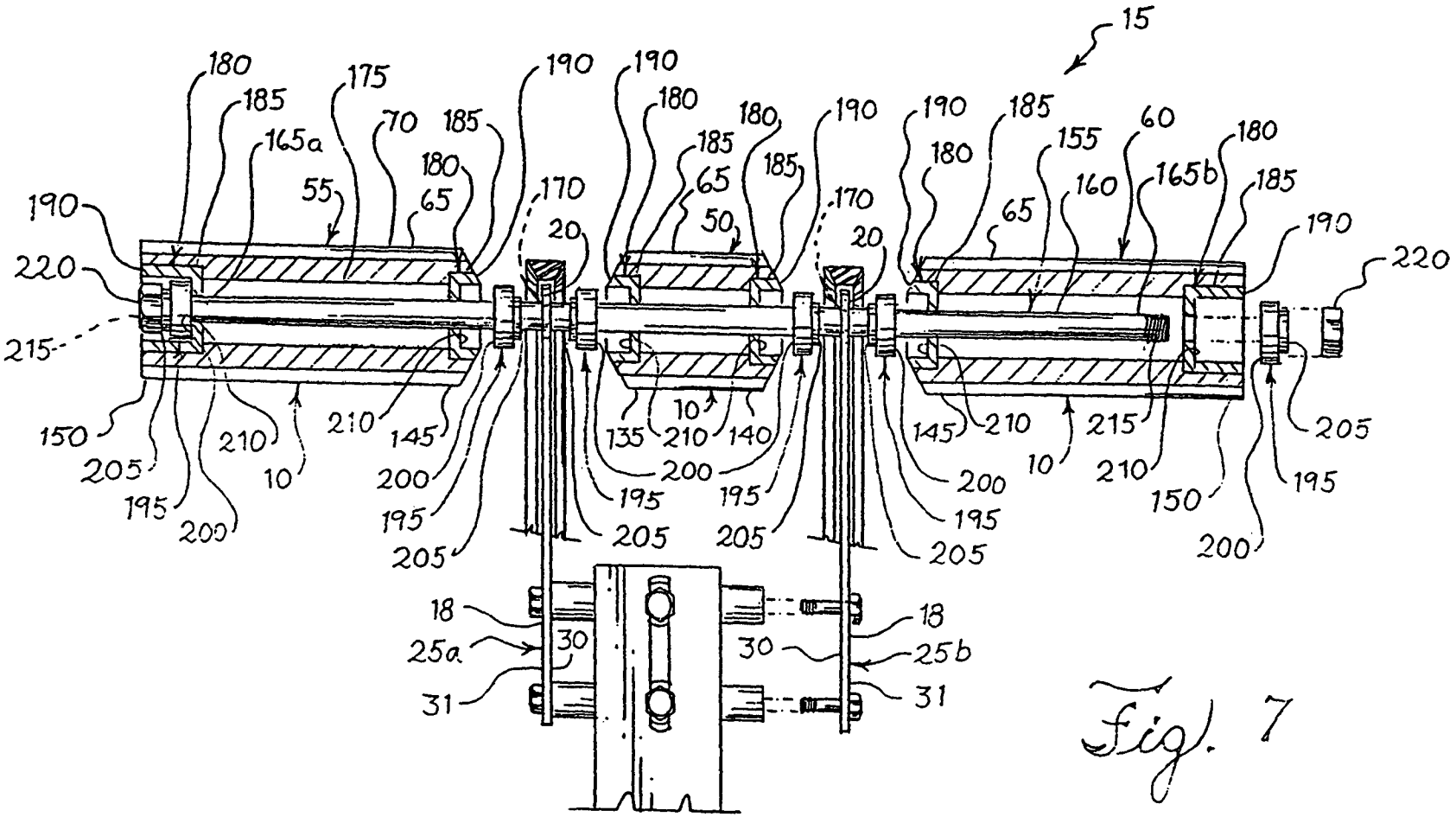
FIG. 7 is a sectional assembly view of the rollers of the roller assembly of the scrubber illustrated in FIG. 2.

The rotatable association of each roller of the at least one roller 10 to a given scrubber is facilitated by various means understood in the art. FIGS. 6 and 7 are sectional assembly views of the roller assemblies 15 of the scrubbers 5 of FIGS. 1 and 2, each comprised of the at least one improved roller 10. As illustrated in FIG. 6 in relation to rotary scrubbers 5 utilizing a single arm 25 defining the sides 28 and 29, the at least one roller 10 of the assembly 15, namely the first and second rollers 40 and 45 rotatably associated with the arm of the scrubber, each define inner and outer ends 115 and 120. As illustrated in FIG. 7 in relation to rotary scrubbers 5 utilizing a pair of arms 25*a* and 25*b* defining the inner and outer sides 30 and 31, respectively, the at least one roller 10 of the assembly 15, namely the central roller 50 and each outer roller 55 and 60 rotatably associated with the pair of arms of the scrubber, respectively define opposite ends 135 and 140 and inner and outer ends 145 and 150.

As illustrated respectively in FIGS. 6 and 7, for scrubber embodiments utilizing either a single arm 25 or a pair of arms 25*a* and 25*b*, a roller assembly shaft 155, defining an outer surface 160 and opposite ends 165*a* and 165*b*, extends through an assembly bore 170 defined at the forward end 20 of each arm. The shaft 155 also extends at least into each roller 10 of the assembly 15 to define the rotatable association of the assembly with the arm 25 or pair of arms 25*a* and 25*b* of the respective scrubbers. In both scrubber embodiments, each assembly bore 170 is preferably about 0.505 inches in diameter while the outer surface 160 of the roller assembly shaft 155 preferably has a corresponding diameter of about 0.5 inches. It is understood, however, that bores and corresponding shafts of other diameters may be utilized as well. For scrubber embodiments utilizing a single arm or a pair of arms, each roller 10 of the assembly preferably defines about a 1 and ¼ inch inside diameter and about a 2 inch outside diameter to define inner and outer roller surfaces 175 and 70 respectively. However, it is nonetheless understood that each roller of the assembly may define an outside diameter of between about 1 inch and about 5 inches as well.

A circumferal void 180, defining an inner circumferal surface 185 having a diameter greater than each roller's inside diameter but less than the outside diameter, is preferably defined in the opposite ends of the cylindrical body 65 of each roller 10. For the inner and outer ends 115 and 120 of the first and second rollers 40 and 45 of the at least one roller 10 of the roller assembly 15 of FIG. 6, as well as for the opposite ends 135 and 140 of the central roller 50 and inner and outer ends 145 and 150 of the outer rollers 55 and 60 of the at least one roller of the roller assembly of FIG. 7, a seat 190 is located in the circumferal void 180 that engages the circumferal surface 185, with the seat accommodating the placement of at least a thrust bearing and race assembly 195 therein. Each seat 190 is preferably comprised of aluminum and preferably bonded to the respective inner circumferal surfaces 185 of each roller with an adhesive. However, it is understood that the seat may be comprised of any lightweight material as well. It is further understood that each may be connected to the respective roller using a resistance fit or any mechanical means understood in the art. Each seat and may also be unitary with or defined in each roller itself as well.

Each thrust bearing and race assembly 195 has an inner race and offset outer race to define opposite sides 200 and 205 and is located between each seat 190 of each roller 10 and the outer surface 160 of the roller assembly shaft 155 to allow each roller of the at least one roller 10 of the assembly 15 to thus rotate about the shaft. Each seat 190 defines an abutment 210 located at a predetermined distance from the end of each roller. For each roller 10 of the assembly 15, the abutment 210 is adapted for contact with one side 200 of the thrust bearing and race assembly 195 (i.e., the side of the offset outer race). Referring respectively to the rollers 10 of the assemblies 15 of FIGS. 6 and 7, for the seats 190 located at the inner ends 115 of the first and second rollers 40 and 45 proximal to the outer sides 28 and 29 of the arm 25, as well as for seats located in the opposite ends 135 and 140 of the central roller 50 and the inner ends 145 of the outer rollers 55 and 60 proximal to the inner and outer sides 30 and 31 of the arms 25*a* and 25*b*, respectively, the distance of a given abutment 210 from the ends of the rollers is less than the width of the associated thrust bearing and race assembly 195.

This reduced distance allows the other side 205 of the thrust bearing and race assembly 195, i.e. the side not in contact with a roller's given abutment 210, to contact to the respective arms, thus precluding any rotational interference between the a given roller end and the arms themselves when the shaft 155, having each roller thereon, is connected thereto. For the seats 190 defined at the outer ends 120 of the first and second rollers 40 and 45 of the roller assembly 15 of FIG. 6, as well for those defined in the outer ends 150 of the outer rollers 55 and 60 of the assembly of FIG. 7, the distance of a given abutment 210 from the respective ends preferably allows the shaft ends to be located within the circumferal void. However, it is understood that any distance may be utilized.

To secure the shaft 155 and each roller 10 to the arm 25 of FIG. 6 or to the arms 25*a* and 25*b* of FIG. 7, the shaft preferably defines threads 215 at its opposite ends 165*a* and 165*b* such that nuts 220 threaded thereto exert lateral forces against the sides of the thrust bearing and race assemblies 195 (via the sides of the offset outer race) located at the outer ends 120 of the first and second rollers 40 and 45 and at the outer ends 150 of the outer rollers 55 and 60, respectively. Thus, when the nuts 220 are fastened to the threaded ends of the roller assembly shaft 155 and against the thrust bearing and race assemblies 195 located at the outer ends of the respective rollers, the forces created thereby are transmitted laterally through the rollers and remaining bearing assemblies via the abutments 210, and to the arm 25 or arms 25*a* and 25*b*, to rotatably secure each roller 10 thereto while avoiding the occurrence of any rotational interference between the roller ends and arms. Thus, as illustrated in FIGS. 6 and 7, the rotatable association of each roller 10 to the scrubber 5 comprises the shaft 155 connected to the scrubber, with thrust bearing and race assemblies 195 located between each roller and the shaft.

Figure 8:
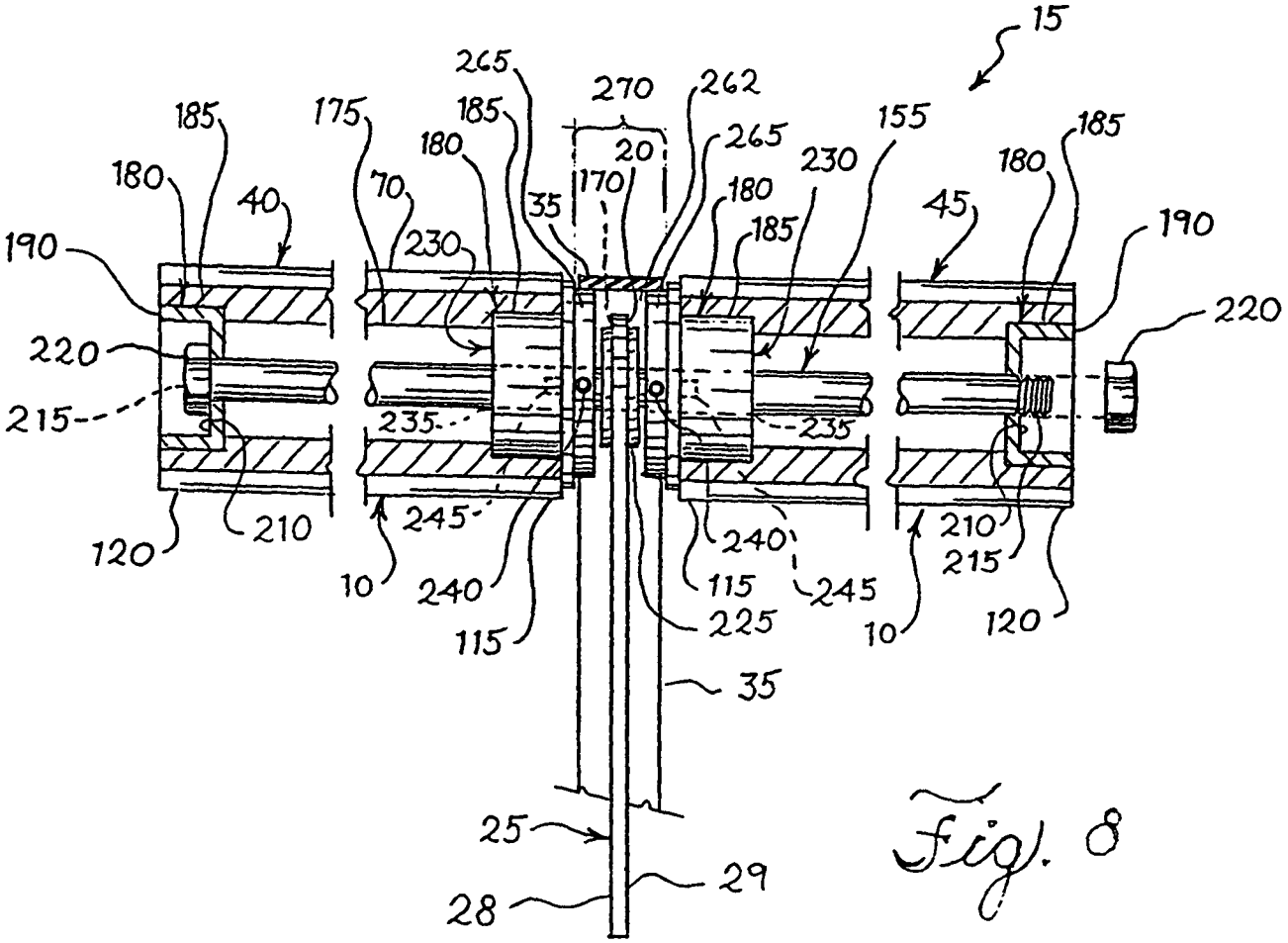
FIG. 8 is a sectional view of the roller assembly of FIG. 6 illustrating an alternate rotational association between the rollers, shaft and arm.
Figure 9:
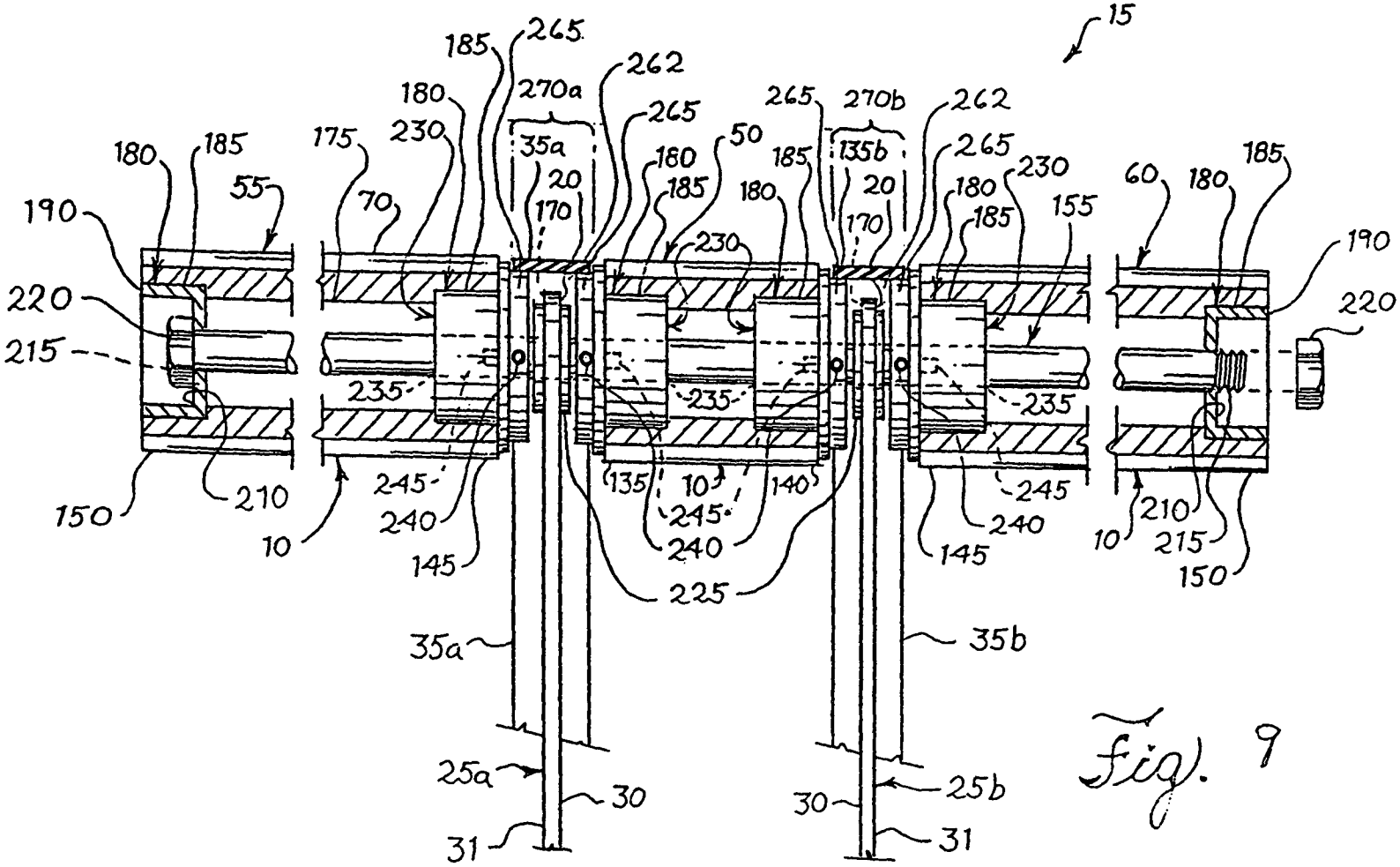
FIG. 9 is a sectional view of the roller assembly of FIG. 7 illustrating an alternate rotational association between the rollers, shaft and arms.

While FIGS. 6 and 7 illustrate that each roller of the at least one roller 10 of the assembly 15 rotates about the shaft 155 connected to the single 25 or pair of arms 25*a* and 25*b* of the scrubber via thrust bearing and race assemblies 195 located between the shaft and the seats 211 of each roller, FIGS. 8 and 9 illustrate each roller of the at least one roller of the assembly affixed to the shaft, with the shaft rotatably connected to the scrubber via one or more bearing and race assemblies located there-between. As illustrated therein, a press-fit bearing and race assembly 225 is located between the shaft 155 and the roller assembly bore 170 defined at the forward end 20 of the arm 25 or pair of arms 25*a* and 25*b* to allow the shaft to rotate in relation thereto. Each roller 10 of the assembly 15 again preferably defines about a 1 and ¼ inch inside diameter and about a 2 inch outside diameter to define inner and outer roller surfaces 175 and 70 respectively. However, it is again understood that each roller of the assembly may define an outside diameter of between about 1 inch and about 5 inches as well. A circumferal void 180, again defining an inner circumferal surface 185 having a diameter greater than each roller's inside diameter but less than the outside diameter, is again preferably defined at the opposite ends of each roller 10.

However, the circumferal voids 180 defined in at least the inner ends 115 of the respective first and second rollers 40 and 45 of the at least one roller 10 of the roller assembly 15 of FIG. 8, as well as in the opposite ends 135 and 140 of the central roller 50 and inner ends 145 of the respective outer rollers 55 and 60 of the at least one roller of the roller assembly of FIG. 9, each preferably accommodate the placement of a roller support 230 therein in lieu of the seat, with each roller support defining a support bore 235 therein adapted for mating engagement with the shaft 155. A set-screw 240 intersects the support bore 235 of each support 230 for engagement with a respective recess 245 defined on the shaft. Each set-screw 240, when engaged with an associated recess 245 of the shaft 155, thus releasably affixes each roller of the assembly 15 to the shaft.

Because of the presence of the press-fit bearing and race assemblies 225 located between the respective arms and the shaft, the bearing and race assemblies 195 are absent from the seats 190 located at the outer ends 120 of the respective first and second rollers 45 and 50 (FIG. 8) and at the outer ends 150 of the respective outer rollers 55 and 60 (FIG. 9), with the nuts 220 fastened to the threads 215 of the shaft and against the abutments 210 of the seats. Each roller support 230 is preferably comprised of aluminum and preferably bonded to the respective inner circumferal surfaces 185 of each roller with an adhesive. However, it is understood that the support may be comprised of any lightweight material as well. It is further understood that each may be connected to the respective roller using a resistance fit or any mechanical means understood in the art.

Figure 10:
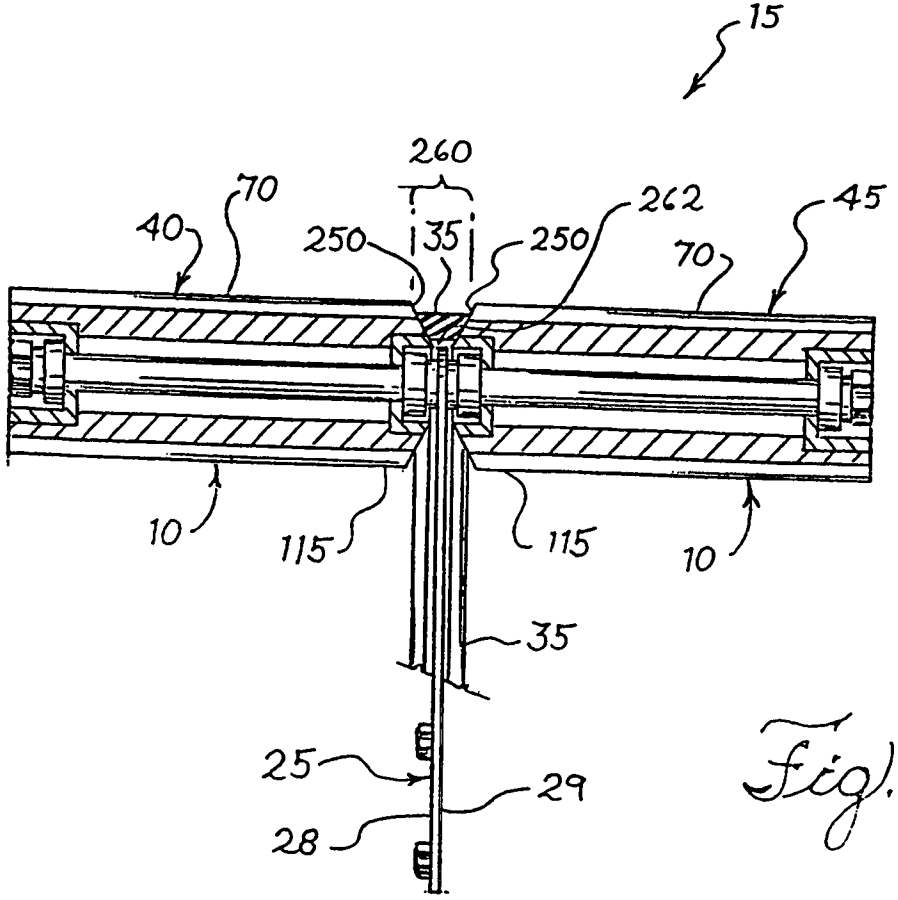
FIG. 10 is a sectional view of the roller assembly of the scrubber illustrated in FIG. 1 showing the groove defined by the circumferal inlets.

In addition to the opposite ends of the cylindrical body 65 of each roller 10 each defining a circumferal void 180 to accommodate the seats 190 or roller supports 230, the outer surface of the cylindrical body 65 of each roller 10 of the assembly 15 defines at least one circumferal inlet to accommodate the operable relation of the scrubber's drive belt 35 or belts 35*a* and 35*b* therewith. Referring to FIG. 10, the inner ends 115 of the first and second rollers 40 and 45 of the at least one roller 10 located respectively proximal to the outer sides 28 and 29 of arm 25 each define an inner circumferal inlet 250 in the outer surface 70 of the roller. The inner circumferal inlets 250 of the first and second rollers 40 and 45 together define a groove 260 in the roller assembly 15 for operable engagement with the drive belt 35.

Figure 11:
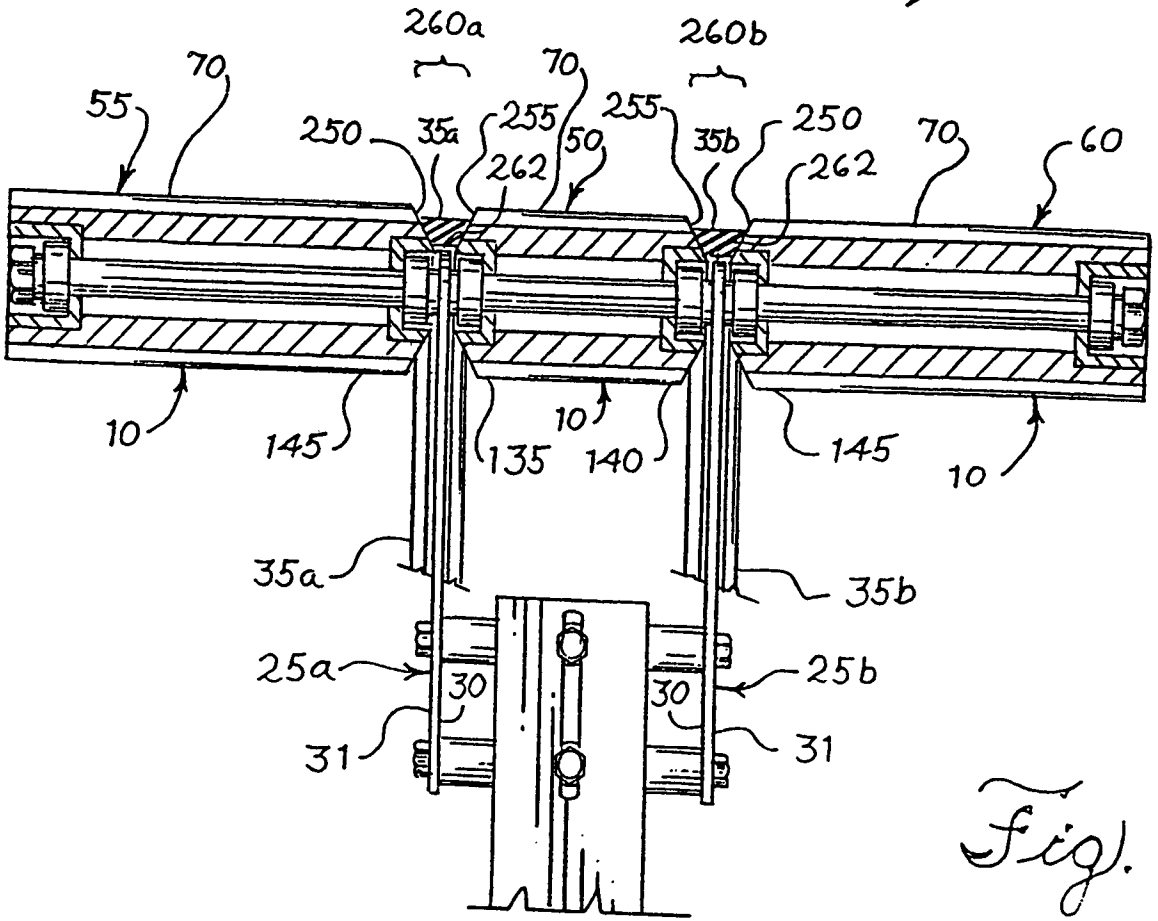
FIG. 11 is a sectional view of the roller assembly of the scrubber illustrated in FIG. 2 showing the grooves defined by the inner and outer circumferal inlets.

Referring to the at least one roller 10 of the roller assembly 15 of FIG. 11, the opposite ends 135 and 140 of the central roller 50 located proximal to the inner side 30 of each of the pair of arms 25*a* and 25*b* each thus define an outer circumferal inlet 255 in the outer surface 70 of the roller. The inner ends 145 of the outer rollers 55 and 60 located proximal to the outer sides 31 of the arms 25*a* and 25*b* each define an inner circumferal inlet 250 in the respective outer surfaces 70 of each roller. The outer and inner circumferal inlets 255 and 250 of the central 50 and two outer rollers 55 and 60 together define a pair of grooves 260*a* and 260*b* in the roller assembly 15 for operable engagement with the drive belts 35*a* and 35*b*. The groove 260 of FIG. 10 and the pair of grooves 260*a* and 260*b* of FIG. 11 thus define the operable relationship of each belt with the roller assembly 15 of each respective scrubber.

Each circumferal inlet defines a cross-section and depth such that their combination defines a groove having a cross-section and depth sufficient to accommodate the associated drive belt therein. In the one embodiment illustrated in FIGS. 10 and 11, each circumferal inlet preferably defines a downwardly sloped surface to define a groove having a substantially "V" or trapezoidal cross-section, thus accommodating a belt of like cross-section therein. However, it is understood that the circumferal inlets may define grooves having any cross-sectional shape to accommodate a belt of similar cross-section. For example, if the belt has a square or rectangular cross-section, then each circumferal inlet preferably defines a right angle to define a groove having a substantially square or rectangular cross-section. Similarly, if the belt has a circular cross-section, then each circumferal inlet preferably defines a groove having a cross-section defining a chord or semi-circle.

Figure 12:
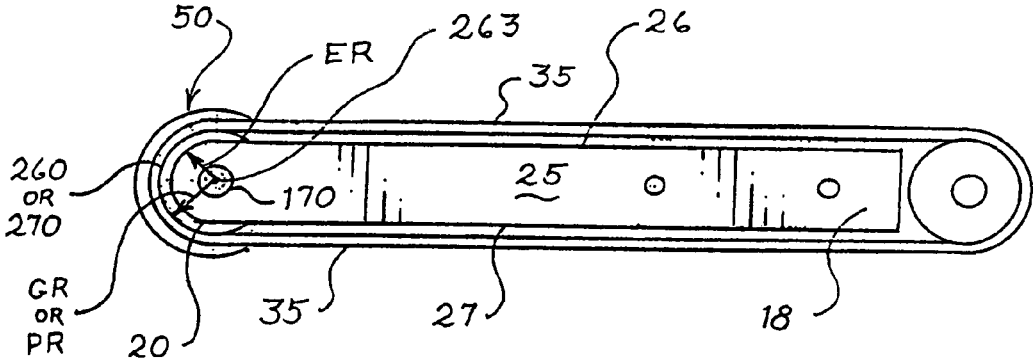
FIG. 12 is a side view of one of the arms of the scrubber illustrating its relationship with the improved roller and drive belt.

Regardless of the shape of the groove cross-section defined by the circumferal inlets 250 and 255, as illustrated in FIGS. 10 and 11, because the groove 260 or grooves 260*a* and 260*b* of the rollers 10 of a given roller assembly 15 are defined by circumferal inlets located on opposite sides of the arm 25 or pair of arms 25*a* and 25*b*, a gap 262 is defined in each groove due to the presence of the arm located there-between. Referring to FIG. 12 in addition to FIGS. 10 and 11, to ensure that a drive belt, when engaged with a given groove, does not contact the upper and lower edges 26 and 27 or rounded forward end 20 of a given arm (only arm 25, belt 35 and central roller 50 illustrated by example) located respectively within a given gap 262, the depth of each groove (i.e., groove 260) is defined by a groove radius GR, as measured from an axis 263 defined by the roller assembly bores 170 of the arm or arms, that exceeds the end radius ER of the arms' rounded ends defining each arm's top-to-bottom depth. Also, to ensure that the given drive belt engaged with a given arm is not drawn into the respective gap 262 defined therein, each groove defines a width that both accommodates the drive belt and exceeds that of the gap.

Alternatively, referring again to the at least one roller 10 of the roller assembly 15 of FIG. 8, the roller supports 230 located at the inner ends 115 of the first and second rollers 40 and 45 each define a pulley surface 265. The pulley surfaces 265 of the first and second rollers 40 and 45 together define a pulley 270 in the roller assembly 15 for operable engagement with the drive belt 35. Referring again to the at least one roller 10 of the roller assembly 15 of FIG. 9, the roller supports 230 located at the opposite ends 135 and 140 of the central roller 50 and at the inner ends 145 of the outer rollers 55 and 60 each define pulley surface 265 to define respective pulleys 270*a* and 270*b* in the roller assembly 15 for operable engagement with the drive belts 35*a* and 35*b*. While FIGS. 10 and 11 illustrate a groove defined by inlets located at respective roller ends and while FIGS. 8 and 9 illustrate a pulley defined by the pulley surfaces of the roller supports located at respective roller ends, it is understood that the groove or pulley may be defined anywhere along the length of the roller as well.

Because the pulley 270 or pulleys 270*a* and 270*b* of the rollers 10 of a given roller assembly 15 are defined by pulley surfaces located on opposite sides of the arm 25 or pair of arms 25*a* and 25*b*, a gap 262 is again defined due to the presence of the arm located there-between. Referring again to FIG. 12, to ensure that a drive belt, when engaged with a given pulley, does not contact the upper and lower edges 26 and 27 or rounded forward end 20 of a given arm (only arm 25, belt 35 and central roller 50 illustrated by example) located respectively within a given gap 262, each pulley (i.e., pulley 270) defines a radius PR, again as measured from an axis 263 defined by the roller assembly bores 170 of the arm or arms, that the exceeds the end radius ER of the arms' rounded ends defining each arm's top-to-bottom depth. Also, to ensure that the given drive belt engaged with a given arm is not drawn into the respective gap 262 defined therein, each pulley defines a width that both accommodates the drive belt and exceeds that of the gap.

While the foregoing description and accompanying drawings are illustrative, other variations in structure and method are possible without departing from the spirit and scope.

I claim:

1. A roller for a rotary scrubber comprising:

a cylindrical body having at least an outer surface defining a plurality of longitudinal ribs, each rib defining at least one edge;

wherein the cylindrical body has a length of between about 1 inch and about 62 inches;

wherein the cylindrical body is comprised of a polyurethane material having a durometer hardness of about 75D.

2. A roller for a rotary scrubber comprising:

a cylindrical body having at least an outer surface defining a plurality of longitudinal ribs, each rib defining at least one edge;

wherein the cylindrical body is comprised of a polyurethane material having a durometer hardness of between about 75D and about 85D.

3. A roller assembly for a rotary scrubber comprising:

at least one roller having a length of between about 1 inch and about 62 inches and having an outer surface defining a plurality of longitudinal ribs of triangular cross-section, each rib defining a base having a width of between about ⅛ of an inch and ½ of an inch and a height of between about ⅛ of an inch and ¼ of an inch, the base of each rib longitudinally co-terminus with one another;

wherein the roller is comprised of a polyurethane material having a durometer hardness of between about 75D and about 85D.

4. In a rotary scrubber having a driven roller assembly rotatably associated with at least one arm and comprised of at least one roller, the improvement comprising a cylindrical body adapted for use as the at least one roller of the assembly and having at least an outer surface defining a plurality of longitudinal ribs, each rib defining at least one edge to enhance the removal of excess spray-applied insulation;

wherein the cylindrical body is comprised of a polyurethane material having a durometer hardness of between about 75D and about 85D.

* * * * *